United States Patent [19]

Katsuyama et al.

[11] Patent Number: 4,915,599

[45] Date of Patent: Apr. 10, 1990

[54] COATING MATERIAL SUPPLY DEVICE

[75] Inventors: Kazuo Katsuyama, Toyota; Yutaka Ohhashi, Aichi; Kenji Fukuta, Toyota, all of Japan

[73] Assignees: Trinity Industrial Corporation, Tokyo; Toyota Jidosha Kabushiki Kaisha, Toyota, both of Japan

[21] Appl. No.: 254,979

[22] Filed: Oct. 7, 1988

Related U.S. Application Data

[62] Division of Ser. No. 109,264, Oct. 14, 1987.

[30] Foreign Application Priority Data

Oct. 31, 1986 [JP] Japan ..... 61-258443

[51] Int. Cl.[4] ..... F04B 43/06; B05B 15/02

[52] U.S. Cl. ..... 417/393; 222/135; 239/305; 239/DIG. 14

[58] Field of Search ..... 417/393, 397, 401, 403, 417/404, 427; 222/136, 135; 239/112, 113, 304, 305, DIG. 14; 118/302; 427/421

[56] References Cited

U.S. PATENT DOCUMENTS

| | | | |
|---|---|---|---|
| 3,857,513 | 12/1974 | Wiggins | 239/112 X |
| 4,265,858 | 5/1981 | Grum et al. | 417/392 |
| 4,375,865 | 3/1983 | Springer | 222/135 |
| 4,509,684 | 4/1985 | Schowiak | 239/305 |

FOREIGN PATENT DOCUMENTS

| | | | |
|---|---|---|---|
| 48109 | 9/1981 | Japan | 417/393 |

*Primary Examiner*—Leonard E. Smith

*Attorney, Agent, or Firm*—Cushman, Darby & Cushman

[57] ABSTRACT

A coating material supply device in which coating material is pumped out at a predetermined flow rate and supplied at a constant flow rate to a coating machine. The device includes a plurality of double-acting reciprocal pumps, each having an inlet for the coating material supplied from a coating material supply source and an exit for discharging the coating material by the pressure of hydraulic fluid supplied at a constant flow rate from a hydraulic fluid supply source. The exits are connected to coating material selection valves connected in parallel with each other to the coating machine, and connected to switching valves that selectively switch the flow channel for the hydraulic fluid supplied from the hydraulic fluid supply source in response to the switching operation of the coating material selection valves. A flow rate control mechanism for maintaining the flow rate of the hydraulic fluid constant is disposed in the flow channel for the hydraulic fluid, between the hydraulic fluid supply source and the switching valves.

4 Claims, 1 Drawing Sheet

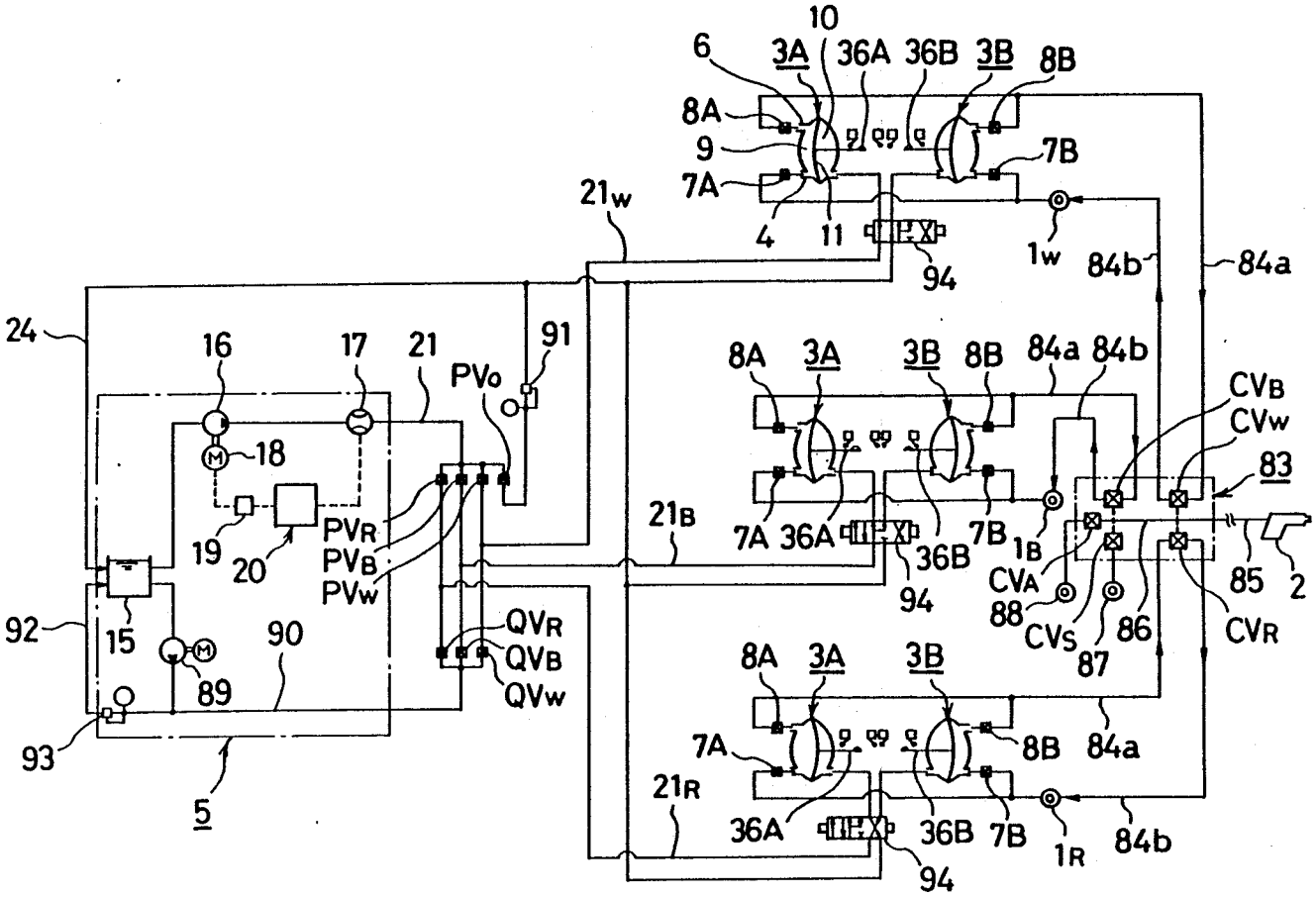
2
83
85
84a
84b
CVB
CVW
CVR
86
87
88
CVA
CVS
1B
1W
1R
8B
7B
3B
36B
94
10
3A
36A
11
4
6
8A
9
7A
21B
21W
21R
91
PVO
QVR
QVB
QVW
21
17
PVR
PVB
PVW
18
20
19
90
16
89
5
15
24
92
93

COATING MATERIAL SUPPLY DEVICE

This is a division of application Ser. No. 07/109,264, filed Oct. 14, 1987.

BACKGROUND OF THE INVENTION

1. Field of the Invention

The present invention concerns a coating material supply device for supplying a coating material at a predetermined flow rate to various types of coating machines such as an air atomizing spray gun, an airless atomizing spray gun or an electrostatic atomizing bell or disc type coating machine. More specifically, it relates to a coating material supply device suitable to a case of supplying, e.g., a two-component type coating material comprising a main agent and a curing agent therefor at a predetermined ratio to a coating machine or to a case of supplying coating material of different colors selectively to a coating machine, e.g., in multicolor coating.

2. Description of the Prior Art

In the coating operation, if the flow rate of a coating material supplied from a coating material source to a coating machine is fluctuated, the amount and the area of spraying the coating material may very to possibly cause unevenness in the coated layers. Accordingly, it is necessary to maintain the flow rate of the coating material supplied to the coating machine always constant.

In view of the above, in the conventional coating material supplying devices, a rotary pump used for supplying the coating material under pressure from a coating material supply source is driven at a constant number of rotation so as to supply a constant amount of coating material to the coating machine.

However, even if the rotary pump is driven at a constant number of rotation, the flow rate of the coating material may vary due to the change in the pressure loss at the suction port or discharge port of the rotary pump depending on the flowing state of the coating material, etc. and there has been a problem, e.g., in a two-component coating material that the main agent and the curing agent therefor can not be supplied at an accurate mixing ratio.

In a two-component type coating material, the main agent and the curing agent supplied separately from their respective reservoirs have to be mixed in a precisely determined ratio upon or just prior to the spraying from the coating machine. If the flow rate for the main agent or the curing agent varies to cause a delicate change in the mixing ratio, no uniform curing can be obtained for the coated layer thus result in unsatisfactory coating such as defective drying or development of crackings in the coated layers.

In view of the above, it has been attempted in the prior art to maintain an accurate flow rate for each of the main agent and the curing agent depending on the mixing ratio by measuring the flow rate for these agents supplied individually from their respective reservoirs by means of a rotary pump to the coating machine by flow meters disposed respectively to the flow channel for the main agent and that for the curing agent, thereby controlling the output from each of the rotary pumps based on the measured values.

However, since most of two-component coating materials are highly viscous as compared with usual paints, it is extremely difficult to accurately measure the flow rate by the flowmeter disposed in the flow channel for the main agent or the curing agent. In addition, there has been a problem that the viscous coating material adheres to the flowmeter thereby causing erroneous operation or failure. Thus, it has been extremely difficult to maintain the flow rate constant upon supplying the coating material to the coating machine.

In order to overcome such problems, use of a supersonic type flowmeter may be considered for contactless external measurement for the flow rate. However, the flowmeter of this kind is not practical for this purpose since it is extremely expensive and results in another problem of picking-up external noises to cause erroneous operation.

Further, use of a gear pump may be considered for supplying a highly viscous paint under pressure. However, there has been a problem that the viscous coating material adheres and clogs at the bearing portion of the gear pump during long time operation to often interrupt the rotation of the pump. In addition, in the case of of using a highly viscous paint, particularly, a metallic paint, the metal ingredient is ground by the gear pump failing to obtain uniform coating quality.

Further, in a car coating line where coating materials of multiple colors, e.g., from 30 to 60 kinds of different colors are coated while conducting color-change, since the flow rate of the coating material of each color supplied under pressure from each of the coating material reservoirs by each of the pumps has to be controlled uniformly, it is necessary to dispose a flowmeter for the coating material of each color, which remarkably increases the installation cost.

There have been proposed, for the related prior art, Japanese Patent Application Laying Open Nos. Sho 56-34988, Sho 60-48160, Sho 61-120660, Japanese Utility Model Publication No. Sho 60-17250, Japanese Utility Model Application Laying Open No. Sho 61-191146, etc.

SUMMARY OF THE INVENTION

Accordingly, it is the principal object of the present invention to provide a coating material supply device capable of accurately supplying even a highly viscous coating material such as a two-component coating material by a constant amount to a coating machine with no troubles, as well as with no requirement of individualy disposing flowmeters, e.g., for respective colors in the case of multicolor coating under color-change.

The above-mentioned object of the present invention can be attained by a coating material supply device in which coating material is pumped out at a predetermined flow rate and supplied at a constant flow rate to a coating machine, wherein the device comprises:

a plurality of double-acting reciprocal pumping means, each having an inlet for the coating material supplied from a coating material supply source and an exit for discharging the coating material by the pressure of hydraulic fluid supplied at a constant flow rate from a hydraulic fluid supply source, connected to coating material selection valves connected in parallel with each other to the coating machine, and connected to switching valves that selectively switch the flow channel for the hydraulic fluid supplied from the hydraulic fluid supply source in response to the switching operation of the coating material selection valves, in which a flow rate control mechanism for maintaining the flow rate of the hydraulic fluid constant is disposed to the flow channel for the hydraulic fluid between the hydraulic fluid supply source and the switching valves.

DESCRIPTION OF THE ACCOMPANYING DRAWINGS

These and other objects, as well as advantageous features of the present invention will become apparent by the description for the preferred embodiment thereof referring to the accompanying drawing, wherein The appended figure is a flow sheet illustrating a preferred embodiment of the present invention applied to a multi-color coating apparatus, in which coating materials each comprising a painting material for each color supplied from each coating material supply source is discharged at a predetermined flow rate and supplied to a coating machine at a constant flow rate.

DESCRIPTION OF THE PREFERRED EMBODIMENT

Each one pair of the double-acting reciprocal pumps 3A, 3B as shown in FIG. 1 of the aforesaid parent application Ser. No. 07/109,264, filed Oct. 14, 1987, is connected to each of coating material selection valves $CV_W$, $CV_B$ and $CV_R$ of a color-change device 83 connected in parallel with the coating machine 2, as well as connected to each of first switching valves $PV_W$, $PV_B$ and $PV_R$ for selectively switching the first supply flow channel 21 that supplies the hydraulic fluid at a constant flow rate from the actuation fluid supply source 5 to each pair of the double-acting reciprocal pumps 3A, 3B in accordance with the switching operation of the coating material selection valves $CV_W$, $CV_B$ and $CV_R$. Further, a flow rate control mechanism comprising a flow sensor 17, a flow rate control device 20, etc. is disposed at the midway of the supply channel 21 of the hydraulic fluid between the hydraulic fluid supply source 5 and the switching valves $PV_W$, $PV_B$ and $PV_R$.

In each of the double-acting reciprocal pumps 3A, 3B, coating material supplied from each of the coating material supply sources $1_W$, $1_B$, $1_R$ and charged from an inlet 4 for coating material by the pressure of hydraulic fluid supplied at a constant flow rate from a hydraulic fluid supply source 5. Each of ON-OFF valves 7A, 7B disposed to the flow channel on the side of the inlet 4 is closed when the coating material is pumped out from the exit 6, whereas each of ON-OFF valves 8A, 8B disposed to the flow channel on the side of the exit 6 is closed when the coating material is charged from the inlet 4.

In each of the double-acting reciprocal pumps 3A and 3B, a coating material chamber 9 having the inlet 4 and the exit 6 and a hydraulic fluid chamber 10 receiving the supply of the hydraulic fluid are formed in adjacent with each other by way of a diaphragm 11, so that the coating material in the coating material chamber 9 is pumped out at a constant low rate by the diaphragm 11 actuated by the pressure of the hydraulic fluid supplied at a predetermined flow rate from the hydraulic fluid supply source 5 to the hydraulic fluid chamber 10.

Each pair of the double-acting reciprocal pumps 3A. 3B is so adapted that is always circulates the paint supplied from the coating material supply source $1_W$ for white paint, the coating material supply source $1_B$ for black paint and the coating material supply source $1_R$ for red paint in such a way that the paint is discharged to a forward recycling channel 84*a*, passed through each of the coating material selection valves $CV_W$, $CV_R$ and $CV_R$ and then returned through a backward recycling channel 84*b* again to each of the coating material supply sources $1_W$, $1_B$ and $1_R$.

In the color-change device 83, each of the coating material selection valves $CV_W$, $CV_B$ and $CV_R$, a solvent selection valve $CV_S$ supplied with a cleaning solvent for color-change from a solvent supply source 87 and an air selection valve $CV_A$ supplied with pressurized cleaning air for color change from an air supply source 88 are connected to the manifold 86 connected by way of a paint hose 85 to the coating machine 2, so that each of the valves are opened and closed selectively.

The hydraulic fluid supply source 5 comprises a reservoir 15 for storing the hydraulic fluid, a rotary pump 16 for supplying the hydraulic fluid under pressure in the reservoir 15 to the hydraulic fluid chamber 10 of each of the double-acting reciprocal pumps 3A, 3B, a flow sensor 17 for detecting the flow rate of the hydraulic fluid supplied under pressure by the pump 16, and a flow rate control device 20 that outputs a control signal to an invertor 19 for variable changing the number of the rotation of a driving motor 18 for the rotary pump 16 based on a detection signal from the flow sensor 17. The flow rate control device 20 is so adapted that it compares with flow rate of the hydraulic fluid detected by the flow sensor 17 with a predetermined flow rate of the hydraulic fluid depending on the flow rate of the coating material supplied to the coating machine 2 and, if there is any deviation therebetween, outputs a control signal that variably controls the number of rotation of the driving motor 18 depending on the deviation.

The hydraulic fluid supply source 5 comprises a first supply channel 21 in which the flow rate of the hydraulic fluid supplied under pressure from the reservoir 15 by the pump 16 is always maintained constant in accordance with the flow rate of the coating material supplied to the coating machine 2 and a second supply channel 90 for supplying the hydraulic fluid under pressure in the reservoir 15 by the pump 89 irrespective of the flow rate of the coating material supplied to the coating machine 2.

In the first supply channel 21, each of switching valves $PV_W$, $PV_B$ and $PV_R$ connected to each pair of the double-acting reciprocal pumps 3A, 3B, and a switching valve $P_O$ connected to the discharge channel 24 for recycling the hydraulic fluid discharged from each pair of the double-acting reciprocal pumps 3A, 3B into the reservoir 15 are connected in parallel with each other to the supply channel 21. Further, a back pressure valve 91 is disposed between the switching valve $PV_O$ and the discharge channel 24.

In the second supply channel 90, second switching valves $QV_W$, $QWV_B$ and $QV_R$ are connected in parallel with each other to the hydraulic fluid supply channels $21_W$, $21_B$ and $21_R$ that connects the respective pair of the doubleacting reciprocal pumps 3A, 3B with the first switching valves $PV_W$, $PV_B$ and $PV_R$ respectively, as well as a return channel 92 connected directly to the reservoir 15 is connected.

A back pressure valve 93 is disposed to the return channel 92.

Piston valves 94 are disposed between the hydraulic fluid discharge channel 24 and respective hydraulic fluid supply channels $21_W$, $21_B$ and $21_R$ for alternately supplying the hydraulic fluid to each pair of the double-acting reciprocal pumps 3A and 3B.

Each of the piston valves 94 is adapted to be switched for three states at a predetermined timing by a limit switch operated by rods 36A, 36B interlocking with the diaphragm 11 of each pair of the double-acting reciprocal pumps 3A, 3B.

Although not illustrated, a curing agent is supplied by the coating machine 2 at a predetermined flow rate and mixed just before spraying by using double-acting reciprocal pumps of the same type as the double-acting reciprocal pumps 3A, 3B for supplying coating material at a predetermined flow rate.

The operation of the coating material supply device having the constitution as shown in the Figure will be explained.

At first, the pumps 16 and 89 disposed to the hydraulic fluid supply source 5 are operated simultaneously to supply the hydraulic fluid in the reservoir 15 under pressure through both of the first supply channel 21 and the second supply channel 90.

Since all of the coating material selection valves $CV_W$, $CV_B$ and $CV_R$ of the color-change device 83 are closed before starting the coating, all of the first switching valves $PV_W$, $PV_B$ and $PV_R$ corresponding to them are also closed, while only the switching valve $PV_O$ is opened. Accordingly, the hydraulic fluid supplied under pressure at the constant flow rate through the first supply channel 21 is directly recycled from the switching valve $PV_O$ by way of the discharge channel 24 to the reservoir 15 of the hydraulic fluid supply source 5.

While on the other hand, all of the second switching valves $QV_W$, $QV_B$ and $QV_R$ are kept open and the hydraulic fluid supplied under pressure at an optional flow rate through the second supply channel 90 is supplied from each of the switching valves $QV_W$, $QV_B$ and $QV_R$ through each of the supply channels $21_W$, $21_B$ and $21_R$ to each pair of the double-acting reciprocal pumps 3A, 3B.

That is, each pair of the double-acting reciprocal pumps 3A, 3B continuously pumps out the paint of each color by the optional pressure of the hydraulic fluid supplied from the second supply channel 90 and supplies the paint recyclically to each of the coating material selection valves $CV_W$, $CV_B$ and $CV_R$.

Accordingly, it is possible to prevent the paint supplied by the coating material supply sources $1_W$, $1_B$ and $1_R$ from depositing to the inside of the forward recycling channel **84*a* or to the inside of the return recycling channel 84*b*, which can prevent clogging in the nozzle of the coating machine 2** or the defective coating due to generation of coarse grains.

In the case of starting coating, for example, with white paint in this state, the coating material selection valve $CV_W$ is switched so that it connects the forward recycling channel **84*a* with the manifold 86 in communication with the paint hose 85**, while the first switching valve $PV_W$ is opened in response to the operation of the switching valve $CV_W$ and the switching valve $PV_O$ is closed. Further, the second switching valve $QV_W$ is closed simultaneously therewith.

Thus, the hydraulic fluid is supplied at a constant flow rate from the hydraulic fluid supply source 5 through the supply channels 21 and $21_W$ to the double-acting reciprocal pumps 3A, 3B already charged with the white paint from the coating material supply source $1_W$, and the white paint is discharged at a predetermined flow rate from the pair of reciprocal pumps 3A, 3B operated alternatively by the switching operation of the piston valve 94 and supplied at a constant amount to the coating machine 2 by way of the forward recycling channel **84*a*→manifold 86→paint hose 85**.

Then, when the color-change is conducted from the white to the black paint after the completion of the coating with the white paint, the forward recycling channel **84*a* for the white paint is again connected to the backward recycling channel 84*b*** by the switching of the coating material selection valve $CV_W$ and, in response to the operation of the valve $CV_W$, the first switching valve $PV_W$ is closed, while the switching valve $PV_O$ is opened. Further, the second switching valve $QV_W$ is again opened simultaneously therewith.

Then, the solvent selection valve $CV_S$ and the air selection valve $CV_A$ are alternately opened and closed to wash and remove the white paint remaining in the paint hose 85 and the coating machine 2 with the solvent and the pressurized air supplied from the solvent supply source 87 and the air supply source 88 by way of the manifold 86.

In this way, when the washing for color-change has been completed, the coating material selection valve $CV_B$ is switched so that it connects the forward recycling channel 84 for the black paint with the manifold 86 in communication to the paint hose 85 and, in response to the switching operation of the valve $CV_B$, the first switching valve $PV_B$ is opened, while the switching valve $PV_O$ is closed. Further, the second switching valve $QV_S$ is closed simultaneously therewith.

Thus, the hydraulic fluid is supplied at a constant flow rate from the hydraulic fluid supply source 5 through the supply channels 21 and $21_B$ to the double-acting reciprocating pumps 3A, 3B already supplied with the black paint from the coating material supply source $1_B$, and the black paint is discharged at a predetermined flow rate from the alternately operating paired reciprocal pumps 3A, 3B by the switching of the piston valve 94 and is supplied at a constant amount to the coating machine by way of the forward recycling channel **84*a*→manifold 86→paint hose 85**.

In the constitution as has been described above, since only one set of the flow sensor 17 and the flow rate control device 20 is necessary for maintaining the flow rate of the paint of each color constant even in a case of multicolor coating apparatus that conducts color-change for more than 30 to 60 kinds of colors and it is no more necessary to disposed such a set to each color paint as usual, the installation cast can significantly be reduced.

It is of course possible to adopt various kinds of mechanisms as described in the aforesaid parent application referring to FIGS. 1 to 10 of that application for the coating material supply device shown in the Figure hereof.

The double-acting reciprocal pump 3A, 3B is not restricted only to the type using the diaphragm 11 but it may be a piston type pump.

What is claimed is:

1. A coating material supply device in which coating material is pumped out at a predetermined flow rate and supplied at a constant flow rate to a coating machine, wherein said device comprises:

a plurality of double-acting reciprocal pumping means, each having an inlet for the coating material supplied from a coating material supply source and an exit for discharging said coating material by the pressure of hydraulic fluid supplied at a constant flow rate from a hydraulic fluid supply source, connected to coating material selection valves connected in parallel with each other to the coating machine, and connected to switching valves that selectively switch flow channel for the hydraulic fluid supplied from the hydraulic fluid supply source in response to switching operation of said coating material selection valves, a flow rate control mechanism for maintaining the flow rate of the hydraulic fluid constant being disposed to the flow channel for said hydraulic fluid between the hydraulic fluid supply source and said switching valves, there being a connection between a hydraulic pressure source and the pumping means, the pumping means having a member responsive to hydraulic pressure, said member being connected to the pumping means, said coating material selection valves being provided in controlling relationship to said material supply source and exits, and said switching valves being provided in individual connections between the hydraulic fluid supply source and the pumping means.

2. A coating material supply device as defined in claim 1, wherein the coating material comprises paints of different colors and a paint of a specific color is selected from them by said coating material selection valve that functions as a color-change valve.

3. A coating material supply device as defined in claim 1, wherein the flow rate control mechanism is adapted to conduct feedback control for the number of rotation of the rotary pump that supplies the hydraulic fluid based on the flow rate of the hydraulic fluid detected by a flow meter.

4. A coating material supply device as defined inn claim 1, wherein the flow rate control mechanism is a gear pump the rotation of which is controlled based on the predetermined number of rotation depending on the flow rate of the hydraulic fluid.

* * * * *